US006732402B1

(12) United States Patent
Hsu

(10) Patent No.: US 6,732,402 B1
(45) Date of Patent: May 11, 2004

(54) STRUCTURE OF A DUSTPAN

(76) Inventor: Che Chi Hsu, 5Fl.-3, No. 56, Sec. 2, Jilung Rd., Da-an Chiu, Taipei City (TW)

( * ) Notice: Subject to any disclaimer, the term of this patent is extended or adjusted under 35 U.S.C. 154(b) by 0 days.

(21) Appl. No.: 10/442,053

(22) Filed: May 21, 2003

(51) Int. Cl.[7] ..... A47L 13/52
(52) U.S. Cl. ..... 15/257.6; D32/74; 294/19.1
(58) Field of Search ..... 15/257.6, 257.1, 15/257.3, 257.4; D32/74; 294/19.1, 1.4

(56) References Cited

U.S. PATENT DOCUMENTS 507,826 A * 10/1893 Miller ..... 294/55
953,756 A * 4/1910 Olson ..... 15/257.6
1,410,369 A * 3/1922 Moise ..... 15/257.6
5,671,959 A * 9/1997 Tsou ..... 294/1.4
6,019,405 A * 2/2000 Tsou ..... 294/1.4
6,641,188 B2 * 11/2003 Arceo ..... 294/1.4

* cited by examiner

*Primary Examiner*—Gary K. Graham
(74) *Attorney, Agent, or Firm*—Birch, Stewart, Kolasch & Birch, LLP

(57) ABSTRACT

The present invention provides a structure of a dustpan. The above-mentioned dustpan is with a liftable cover. According to this invention, excluding the practical convenience to users, the garbage, such as hair, dust and unsightly filth, can be efficiently sealed in the dustpan of this invention. Moreover, the present invention can provide a simple and fast mechanism for opening and closing the liftable cover by an operation at the handle of the dustpan. Therefore, this invention can provide a hygienic and convenient dustpan.

3 Claims, 4 Drawing Sheets

STRUCTURE OF A DUSTPAN

BACKGROUND OF THE INVENTION

1. Field of the Invention

The present invention relates a structure of a dustpan, and more particularly, to a structure of a dustpan with a liftable cover.

2. Description of the Prior Art

For centuries, floors have been swept with the aid of a broom constituted by a handle and a brush, a dustpan and a refuse can. The broom is used to collect dust to the dustpan, and dust can be thrown into the refuse can. Dustpans are useful for cleaning the surroundings of home, commercial and industrial buildings.

Dustpans typically have a broad shallow container or scoop attached to a handle. Because a typical dustpan is without a cover to seal the collections therein, such as hair, dust, or gravel sand, the collections may be blown by wind and dispersed around the surroundings. Furthermore, if someone takes a dustpan with an incorrect way, the collections would be poured out, if a dustpan is located in outdoor, and there are a number of edible refuse, such as fruit, skin of fruit, bags of packaging food etc., many mosquitoes and flies are attracted to gather at the dustpan, and many dogs and cats may also be attracted to gather at the dustpan for rummaging their foods. Therefore, the traditional dustpan always brings lots of problem of sanitation and safety.

SUMMARY OF THE INVENTION

In accordance with the present invention, a structure of a dustpan is provided, and the structure comprises a liftable cover. There are a number of advantages to be declared below:

1. This present invention provides a dustpan comprising a liftable cover, wherein the liftable cover can seal the garbage in the dustpan. The above-mentioned design can prevent the garbage from dispersed by wind blowing. Moreover, the above-mentioned design can seal the stink filth and unsightly filth by the liftable cover. Furthermore, the above-mentioned design can prevent the dustpan from attracting mosquitoes, flies, dogs and cats to gather and rummage.
2. This present invention provides a dustpan with an operation function for lifting the liftable cover. According to the above-mentioned design, when pushing a button at the handle, the liftable cover is lifted. When pushing a set-free key of the dustpan of this invention, the liftable cover is closed. Therefore, the above-mentioned design, this present invention can provide a dustpan with a liftable cover in simple, efficient and practical operation.
3. According to the present invention, provides can be lifted by pushing the liftable component with an inner shaft. The mentioned two components are hided inside the dustpan to ensure safety for operating and protecting the mechanism of the components, and thus the lifetime of the components and the dustpan can be extended.
4. According to the design of this present invention, when pushing the handle but not to the terminal point thereof, the liftable cover can be lifted in an appropriate height as requirement. The above-mentioned design can avoid pushing the set-free key for closing the liftable cover, and the height of the liftable cover can be adjusted with the requirement of user. The liftable cover can be automatic closed by gravity when the handle returns to the original position. Therefore, the operation of the dustpan is quicker and simpler.
5. The present invention provides a design of a liftable cover made with a transparent material to confirm the inner state of the dustpan. The liftable cover also may be printed with a number of patterns thereon, such as a bear pattern, a cartoon pattern, and so on, to enhance the additional value of the dustpan.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DESCRIPTION OF THE PREFERRED EMBODIMENT

What is probed into in the invention is a method for preventing wind blow. Detailed steps in production, structure and elements will be provided in the following description in order to make the invention thoroughly understood. Obviously, the application of the invention is not confined to specific details familiar to those who are skilled in electromagnetic inductive system. On the other hand, the common elements and procedures that are known to everyone are not described in the details to avoid unnecessary limits of the invention. Some preferred embodiments of the present invention will now be described in greater detail in the following. However, it should be recognized that the present invention can be practiced in a wide range of other embodiments besides those explicitly described, that is, this invention can also be applied extensively to other embodiments, and the scope of the present invention is expressly not limited except as specified in the accompanying claims.

Figure 1:
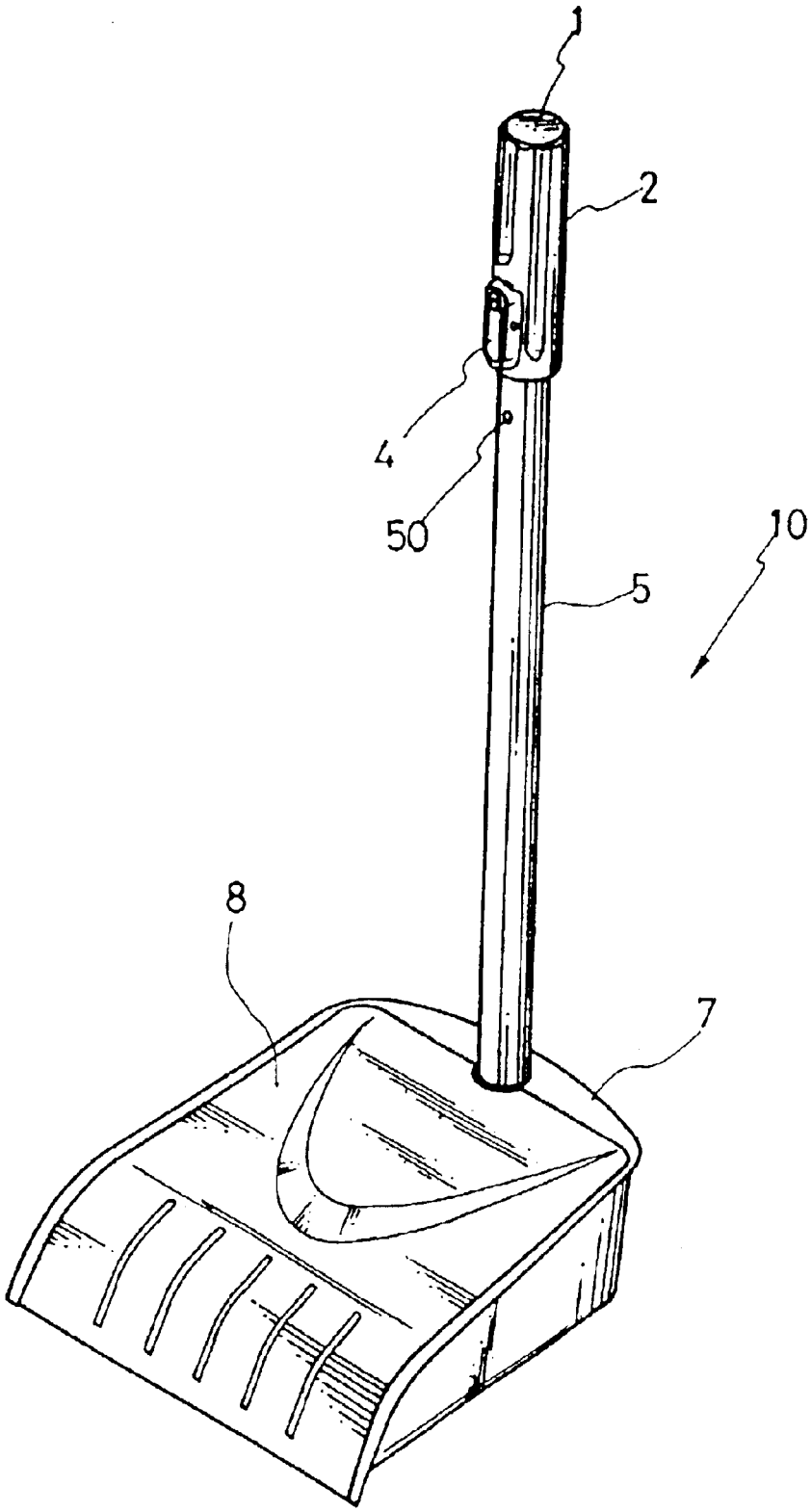
FIG. 1 shows a dustpan in accordance with the first embodiment of this present invention, wherein the dustpan is in the state with a closed liftable cover.

As illustrated in FIG. 1, in the first preferred embodiment of the present invention, this invention provides a dustpan 10 with a liftable cover 8. The dustpan 10 comprises an inlay-cover 1, a handle 2, a spring 3, a set-free key 4, an outer shaft 5, an inner shaft 6, a dustpan body 7, a liftable cover 8, and a liftable component 9. The inlay-cover 1 further comprises an inlay-cover tenon 11, a holding ring 12 and an inlay-shaft tenon 13. The inner shaft 6 further comprises a top hole 61. The inlay-cover 1 is held at the top of the handle 2 by the inlay-cover tenon 11, and the inlay-cover handle 1 is held within the top hole 61 by the holding ring 12 and the inlay-shaft tenon 13. The handle 2 can be held with the inner shaft 6, and the handle 2 and the inner shaft 6 can form a joined movement structure. The outer shaft 5 is a hollow shaft, and the inner shaft 6 is located inside the outer shaft 5. Besides combining the inlay-cover 1 to form a joined movement structure with the handle 2, the inner shaft 6 can slip in the up and down direction of the handle 2 inside the over shaft 5 in operative and appropriate movement. The outer shaft 5 comprises a protruding portion 51, wherein the protruding portion 51 is located at the top of the outer shaft 5 to keep the outer shaft 5 from slipping out of the handle 2 by engaging with a stopper 21 of the handle 2. The spring 3 is inside the handle 2. The handle 2 can slip back and forth in the up and down direction along the outer shaft 5 in operative and appropriate distance by the elasticity of the spring 3. The above movement of the handle 2 can drive the inner shaft 6 slipping back and forth in the up and down direction inside the outer shaft 5, as illustrated in FIG. 3.

The slipping function that the handle 2 slips in the overcoat shaft 5 is operated in coordination with the set-free key 4. The outer shaft 5 further comprises an orientating opening 50, wherein the orientating opening 50 is opposite to the terminal position of the slipping of the handle 2. The set-free key 4 is pivoted in a key trough 22 of the handle 2. Through the elasticity of the inlay-spring 41, when the handle 2 slipping to the terminal position, the orientating tenon 42 of the set-free key 4 is inserted into the orientating opening 50, and thus the automatically orientating function is working by elasticity.

Figure 2:
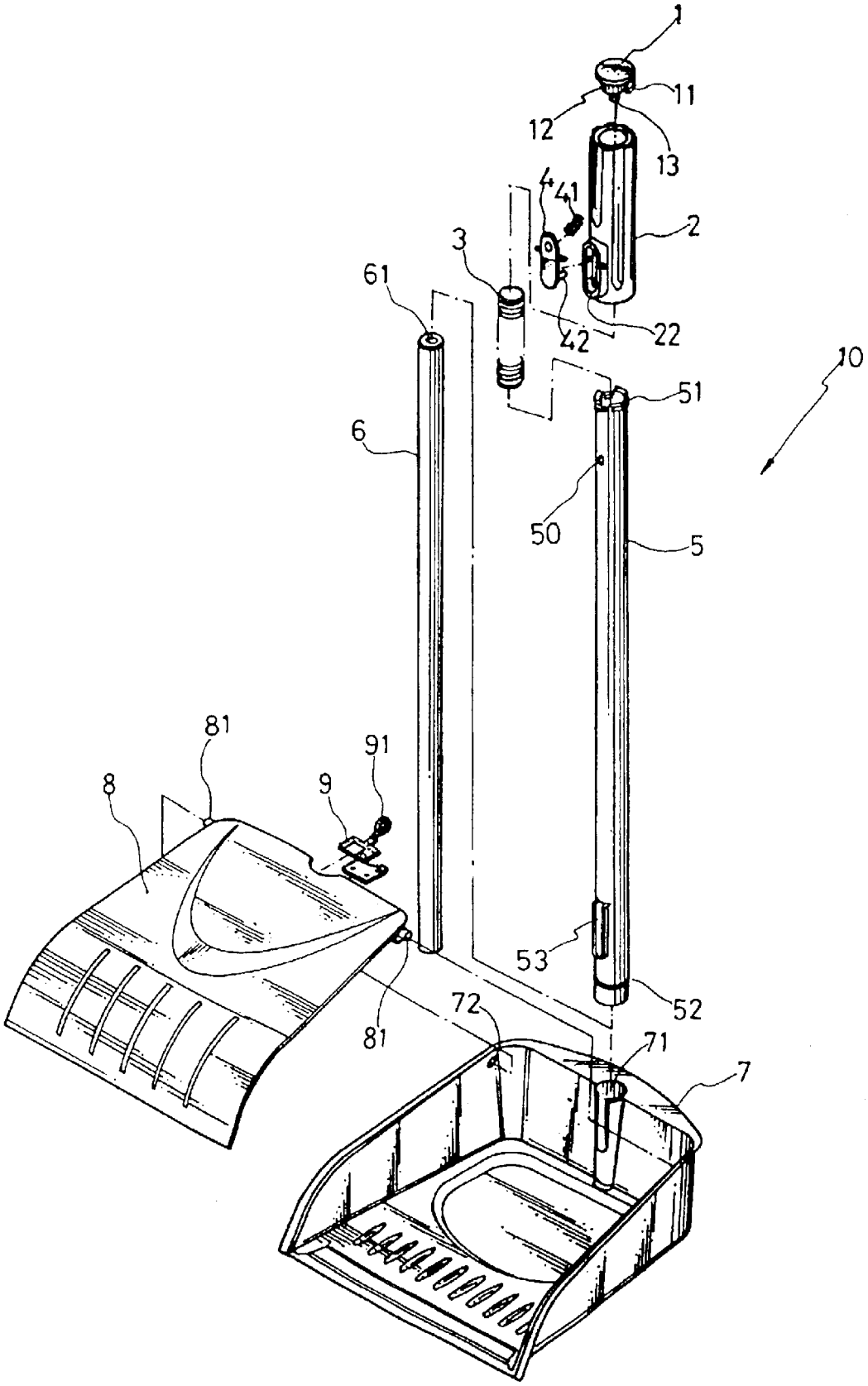
FIG. 2 shows the components of the dustpan in accordance with the first embodiment of the present invention.
Figure 3:
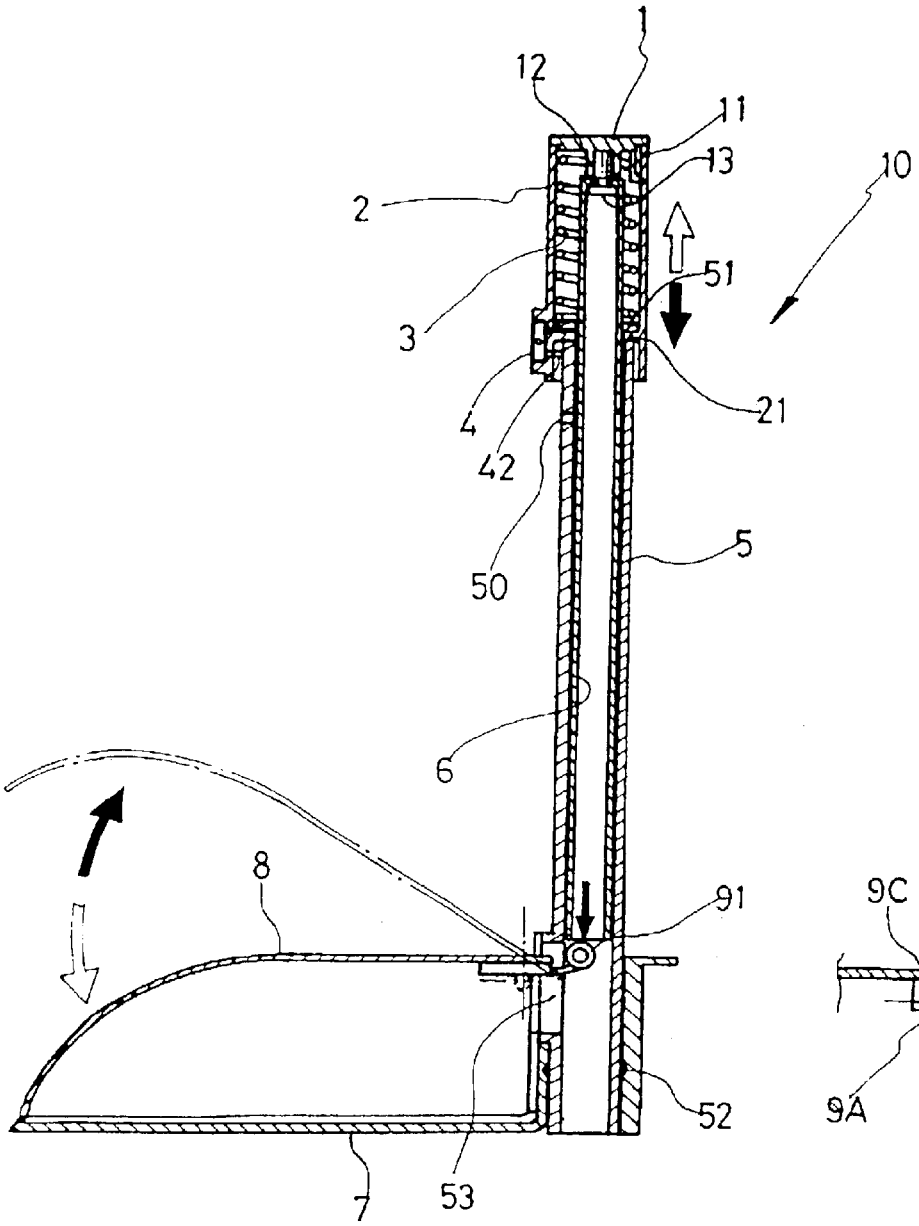
FIG. 3 shows a cutaway view and the operation of the dustpan in accordance with the first embodiment of the present invention.

As illustrated in FIG. 2 and FIG. 3, the bottom of the outer shaft 5 is inserted into an inlay trough 71 of the dustpan body 7 and held by the tenon trough 52. The outer shaft 5 further comprises a slender opening 53 at the outside of the bottom. A liftable component 9 of the liftable cover 8 is at the relative position of the slender opening 53. The liftable component 9 is inserted into the outer shaft 5 through the slender opening 53 by the pushed part 91 of the liftable component 9, wherein the pushed part 91 is located at the bottom of the inner shaft 6.

The liftable cover 8 is a cover that is an arc in front according to the shape of the dustpan body 7. Two pivoting axles 81 are respectively at the side position behind the liftable cover 8, wherein the liftable cover 8 can be pivoted by inserting the pivoting axles 81 into the pivoting holes 72 at the two side walls of the dustpan body 7. Therefore, the liftable cover 8 can be lifted by the pivoting axles 81, and the above lifting movement can be achieved by pushing the liftable component 9.

Figure 5:
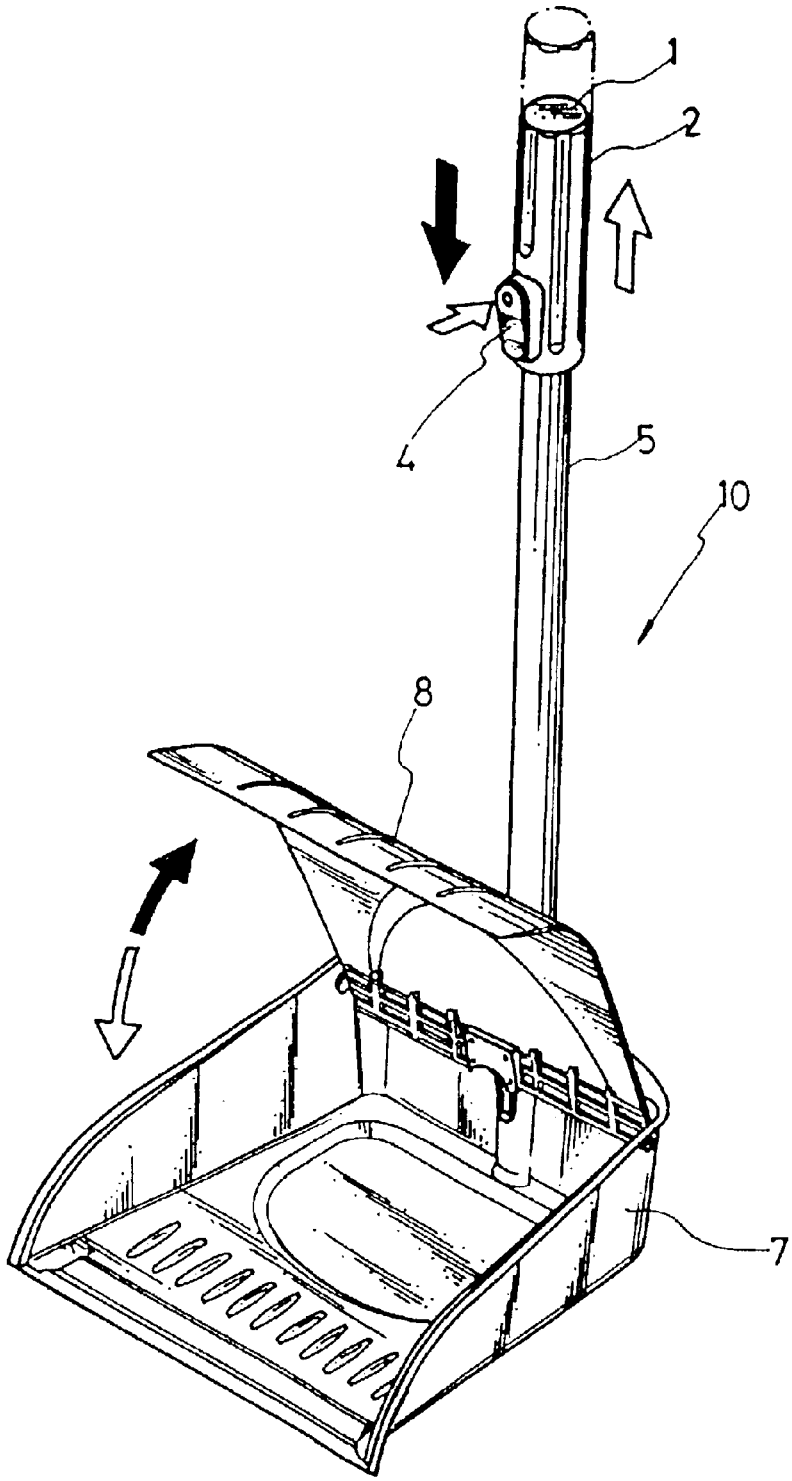
FIG. 5 shows the dustpan in accordance with the present invention, wherein the dustpan is in the state with an opened liftable cover.

The basic operation of the dustpan of this embodiment is as follows. When the handle 2 moved by pushing, the inner shaft 6 pushes the liftable component 9. When the liftable component 9 is pushed, the liftable cover 8 is lifted by the pivoting axles 81. When the liftable cover 8 is completely lifted and the handle 2 is arrived at the terminal point, the handle 2 is held by the set-free key 4 at the side of the handle 2. On the contrary, the handle 2 is automatically moved up by the elasticity of the spring 3 when the set-free key 4 is pushed, and thus the liftable cover 8 is automatically closed due to remove the force on the liftable component 9 as shown in FIG. 5.

Figure 4:
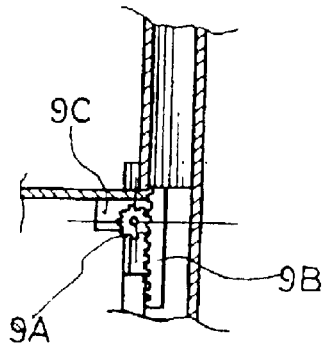
FIG. 4 shows the joined movement structure of the dustpan in accordance with the second embodiment of the present invention.

As illustrated in FIG. 4, in the second preferred embodiment of the present invention, this invention provides a driving method for lifting the liftable cover 8 by replacing the liftable component 9 with the gear wheel 9A and the rack 9B, and there is a joined movement function between the gear wheel 9A and the rack 9B. The liftable cover 8 can be lifted in different states of the lifted position of the liftable cover by the orientating device 9C. Thus, the value and the application of the dustpan according to this present invention can be enhanced by the above-mentioned design.

Although a specific embodiment has been illustrated and described, it will be obvious to those skilled in the art that various modifications may be made without departing from what is intended to be limited solely by the appended claims. Obviously, many modifications and variations of the present invention are possible in light of the above teachings. It is therefore to be understood that within the scope of the appended claims, the present invention may be practiced otherwise than as specifically described herein.

What is claimed is:

1. A structure of a dustpan, comprising:

a hollow handle comprising a key trough in one side of said handle;

an inlay-cover held at a top of said handle, wherein said inlay-cover further comprises an inlay-cover tenon, a holding ring and an inlay-shaft tenon;

an outer shaft comprising a protruding portion at a top thereof, said handle receiving said outer shaft with the protruding portion thereon, wherein said protruding portion is employed to limit said outer shaft slipping out from said handle, wherein said outer shaft further comprises a slender opening at one side of a bottom thereof;

an inner shaft inside said outer shaft, wherein said inner shaft comprises a top hole, wherein said top hole is held with said inlay-cover by said inlay-shaft tenon and said holding ring, and thus said inner shaft and said handle can form a joined movement structure;

a dustpan body held with the bottom of said outer shaft, wherein said dustpan body comprises two pivoting holes at two side wall of said dustpan body;

a liftable cover coupled with said dustpan by pivotally inserting two pivoting axles of said liftable cover into said pivoting holes of said dustpan body;

a liftable provided on said cover at a center behind said liftable cover, wherein said liftable component is inserted into said slender opening of said outer shaft and engages with to the bottom of said inner shaft;

a spring between said handle and said outer shaft, such that said handle can slip up and down direction along said outer shaft by the elasticity of said spring; and a set-free key pivoted in said key trough of said handle.

2. The structure according to claim 1, wherein said liftable component comprises a gear wheel and a rack is provided on said inner shaft.

3. The structure according to claim 1, wherein said liftable cover is made with a transparent material.

* * * * *